United States Patent [19]

Hausen et al.

[11] 4,072,505

[45] Feb. 7, 1978

[54] METHOD OF SLAGGING MOLTEN METAL

[75] Inventors: Peter Hausen; Klaus-Dieter Schulz, both of Dortmund, Germany

[73] Assignee: Hoesch Werke Aktiengesellschaft, Dortmund, Germany

[21] Appl. No.: 729,941

[22] Filed: Oct. 6, 1976

[30] Foreign Application Priority Data

| | | |
|---|---|---|
| Oct. 9, 1975 | Germany | 2545262 |
| Dec. 19, 1975 | Germany | 2557362 |
| Dec. 19, 1975 | Germany | 2557361 |
| Mar. 17, 1976 | Germany | 2611203 |

[51] Int. Cl.[2] ..... C21C 7/00

[52] U.S. Cl. ..... 75/61; 75/30; 75/46; 75/257; 266/228

[58] Field of Search ..... 75/46, 59, 60, 61, 13, 75/94, 30; 210/65; 266/228

[56] References Cited

U.S. PATENT DOCUMENTS

| | | | |
|---|---|---|---|
| 2,993,780 | 7/1961 | Allard | 75/59 |
| 3,201,224 | 8/1965 | Grim | 75/49 |
| 3,340,045 | 9/1967 | Colwell | 75/30 |
| 3,689,250 | 9/1972 | Roeder et al. | 75/12 |
| 3,761,242 | 9/1973 | Finkl | 75/13 |
| 3,883,124 | 5/1975 | Galer | 266/228 |

*Primary Examiner*—M. J. Andrews
*Attorney, Agent, or Firm*—Walter Becker

[57] ABSTRACT

A method of slagging off slag, especially treatment slag, from metal baths, particularly iron baths, in vessels such as crucibles and ladles, by means of a rabble while the vessel is slightly tilted. To this end, a slag-free zone starting at the lifted side of the vessel is created by means of a rinsing gas acting on the bath surface on the lifted side of the vessel so that the slag which originally covered the slag-free zone is partially displaced toward the vessel side opposite the slag-free bath surface. The rabble is then lowered onto the slag-free portion of the metal bath and while engaging the slag from behind, the rabble is pushed so as to force the slag over the vessel rim section opposite the slag-free bath surface.

12 Claims, No Drawings

METHOD OF SLAGGING MOLTEN METAL

The present invention relates to a method for removing the slag, especially treatment slag, from metal baths, especially iron baths, in metallurgical vessels, such as crucibles and ladles, which method is carried out by a rabble by means of which the slag is drawn off over the lowered rim range of the vessel while the latter is slightly tipped.

The slagging off of metal baths presents still a problem which heretofore has not been sufficiently solved. An as complete as possible removal of the slag from a metal bath prior to the further processing of the melt is often a requirement for obtaining a qualitatively high grade end product.

Such complete removal of the slag in conformity with heretofore known methods requires a relatively long slagging off time which affects the productivity while simultaneously there occurs automatically an undesired cooling off of the metal bath. A further drawback of these heretofore known methods consists in considerable losses in metal.

For drawing off slag, so-called rabbles are used which form the mouth of the vessel containing the metal bath are moved to the rear wall of the vessel and after lowering the rabble blade onto the surface of the metal bath are returned to the mouth of the vessel while the slag caught from behind by the blade is withdrawn through the pouring nozzle with the vessel in slightly tilted condition. In special instances the slag is also withdrawn toward that side of the vessel which faces away from the pouring nozzle.

In view of the customary round or oval cross section of the vessel, the blade of the rabble must be limited as to its width so that it can be displaced in the vessel over a sufficiently large area without abutting against the wall of the vessel. Nevertheless in this way the slag at the wall of the vessel, especially in the rear region of the vessel, can practically not at all be caught by the rabble, and the intended complete slagging off can for all practical purposes not be realized.

It is, therefore, an object of the present invention so to improve the slagging off process that the above mentioned drawbacks will be avoided and that the slagging off process is carried out with optimum efficiency.

These and other objects and advantages of the invention have been realized by the method according to the present invention which is characterized primarily by first creating by means of a rinsing gas effective on the bath surface a slag free zone which zone begins at the lifted side of the vessel, and thereupon withdrawing by means of a rabble or rake that portion of the slag which in view of the tilting of the vessel has been displaced toward the lowered side of the vessel.

According to the method of the present invention the slag in the lifted region of the vessel, and this includes also the slag directly adjacent the wall of the vessel, is by means of the rinsing gas which is effective in the region of the wall of the vehicle on the bath surface displaced toward the lowered side of the vessel while a slag-free zone is formed in the direction toward the oppositely located lowered side of the vessel so that the displaced slag can easily be caught from behind by the rabble or rake and in this way can practically completely be withdrawn from the metal bath in the vessel.

The intended effect can also be realized by first creating on the bath surface a slag-free zone extending from the lifted side of the vessel and by creating this zone by means of a rinsing gas which is introduced into the metal bath and rises at the lifted side of the vessel. Expediently the gas is introduced into the metal bath through at least one rinsing gas pipe means (Spulstein) inserted into the wall of the vessel. This rinsing pipe means may be located in the rear wall as well as in the bottom of the vessel but, if desired, the rinsing gas may be introduced into the metal bath by an immersion lance which in such an instance is expediently, in order not to affect the movement of the rabble or rake, inserted in the wall region of the lifted side of the vessel.

According to a modified method of the invention, first a slag-free zone starting from the lifted side of the vessel is created on the bath surface by means of a blower jet directed upon the melt in the wall region of the lifted side of the vessel. The blower jet may be directed perpendicularly to the bath surface but may also be directed against the wall of the vessel.

Expediently, the action upon the melt by means of the gas is continued during the drawing off of the slag by means of the rabble.

As rinsing gas there may be used practically any gas which is neutral with regard to the melt to be treated. As most economical it is suggested to use nitrogen, at least in connection with pig iron melts. If during a treatment of a fusable steel a nitrogenation is to be avoided, another suitable gas, for instance an inert gas such as argon, should be used.

According to a further development of the invention, especially when drawing off slag which does not form a coherent mass or when drawing off slag which splits up during the slagging operation, it is suggested after the formation of the slag-free zone to place onto the cleared bath surface a synthetic slag powder which at the respective temperature of the metal bath forms a coherent viscous slag which in its melted condition, on the one hand, shields the already slag-free bath surface against the process slag displaced in the direction toward the pouring nozzle and, on the other hand, is taken along by the rabble blade engaging the viscous slag from behind and pushes the still to be removed slag toward the pouring nozzle.

The charging of the synthetic slag powder onto the bath surface may be preceded by the slagging off of particularly large slag blocks by means of a rabble.

Advantageously, the charging of the synthetic powder is combined with the actuation of the rabble in such a way that with the rabble moved to the rear wall of the vessel the slag powder is added onto the clean surface of the metal bath between the rabble blade and the process slag already pushed in the direction toward the pouring nozzle.

The adding of the synthetic slag powder may be continued with the repeated slagging stroke of the rabble or rake.

The method according to the present invention thus permits a practically complete removal of the slag. A further advantage of the method of this invention consists in the considerably shorter slagging time. This also results in a considerable reduction in temperature losses. Consequently also a greater throughput and therefore a better exploitation of the installation will be realized; furthermore the losses in iron are considerably reduced by the method according to the invention.

For the synthetic slag for treating pig iron melts, slag powder of the following composition has proved best suited:

$SiO_2$ — 70 - 85%, preferably 73 - 78%
$Al_2O_3$ — 10 - 18%, preferably 10 - 14%
$K_2O$ — 3 - 8%, preferably 3 - 6%
$Na_2O$ — 2 - 6%, preferably 2 - 5%.

The method according to the present invention is not limited to the slagging of melts in tap ladles or pouring ladles but may also be used in connection with melts in melting units, such as electric furnaces. In the last mentioned instance the blowing of the rinsing gas onto the bath surface is preferred.

The method according to the invention is now described in connection with specific examples.

EXAMPLE 1

A 160 ton pig iron ladle the contents of which was subjected to a ladle desulfurization was slagged off in conformity with the invention. To this end, the ladle, equipped at its rear wall approximately 50 cm above the ladle bottom with two rinsing gas pipe means, was placed into the slagging off position, was slightly tilted, and the annular conduit conveying the rinsing gas to the rinsing gas pipe means was connected to a nitrogen feeding line. Thereupon approximately 450 liter of nitrogen per minute were introduced into the pig iron bath at a pressure of approximately 4 kg/cm$^2$.

The rising gas created, starting from the rear wall of the ladle and while displacing the desulfurization slag in the direction toward the pouring nozzle, a clean bath surface.

The blade of the now mechanically actuated rabble was then moved over and beyond the desulfurization slag toward the rear wall of the ladle, and synthetic slag powder was through a conduit associated with the rabble applied to the clear surface of the pig iron bath between the desulfurization slag and the rabble blade. The synthetic slag powder consists of 77% $SiO_2$, 11.2% $Al_2O_3$, 4.6% $K_2O$ and 30% NaO, and the remainder impurities. The slag powder immediately melted while forming a viscous coherent mass. This mass, which extends over the entire width of the ladle and which is engaged from behind by the blade of the rabble lowered onto the bath surface, pushed the desulfurization slag to be slagged off during the subsequent slagging stroke of the rabble in the direction toward the pouring nozzle. The slagging stroke of the rabble was repeated several times and each stroke was preceded by adding additional slag powder to the bath surface until the desulfurization slag was nearly completely removed from the pig iron bath. The extent of slagging amounted to more than 95%.

The time required for the slagging operation was 6 minutes; the loss in iron amounted to approximately 1 ton.

For a comparable slagging operation which uses a rabble only, a time of approximately 20 minutes is required and the extent of slagging amounts to a maximum of 70% while the loss in iron amounts to 7 tons.

EXAMPLE 2

A steel ladle the contents of which was to be subjected to a ladle desulfurization was first slagged in conformity with the present invention.

Tapped in the ladle were 185 tons of steel including adhering slag at a temperature of 1612° C 30 cm below the surface of the melt. For carrying out the slagging operation, the ladle having its bottom provided with rinsing gas pipe means was placed into slagging position, was slightly tilted, and the feeding line for the rinsing gas pipe means was connected to a supply line. Thereupon approximately 600 liter of argon per minute at a pressure of approximately 6 kg/cm$^2$ were introduced into the steel bath.

Starting from the rear wall of the ladle and while displacing the slag in the direction toward the pouring nozzle, the rising gas created a clear bath surface.

The blade of the mechanically operated rabble was then moved above and beyond the slag toward the rear wall of the ladle, and slag powder containing 77% $SiO_2$, 11.2% $Al_2O_3$, 4.6% $K_2O$ and 3% NaO, with the remainder impurities, was through a feeding line associated with the rabble applied to the clear surface of the steel between the slag and the rabble blade which powder immediately melted while forming a viscous coherent mass. This mass, which was engaged from behind by the rabble blade lowered onto the bath surface, extended over the entire width of the ladel and pushed the slag to be withdrawn during the subsequent slagging stroke of the rabble in the direction toward the pouring nozzle. The slagging stroke of the rabble was repeated several times with each time preceded by the application of additional slag powder onto the bath surface until the slag was completely removed from the steel bath.

The slagging time amounted to 4 minutes, and the loss in temperature amounted to about 13° C. The slag-free end weight amounted to 183.2 tons of steel. The following steel desulfurization resulted in a sulfur content of the steel of 0.005%. In contrast thereto, with heretofore known slagging methods — special treatments of the melt excluded — with the remaining working and processing conditions being the same, as best a sulfur content amounting to 0.009% of the liquid steel could be obtained.

It is, of course, to be understood that the present invention is by no means limited to the specific examples set forth above but also comprises any modifications within the scope of the appended claims.

What we claim is:

1. A method of removing slag from metal baths, in metallurgical vessels by means of a rabble, which includes the steps of: slightly tilting the vessel containing the slag covered metal bath while simultaneously by means of a rinsing gas first creating a slag-free zone on the bath surface at the lifted side of the vessel, subsequent to the creation of the slag-free zone at the temperature of the metal bath applying a synthetic slag powder to the slag-free bath surface to form a coherent viscous slag, placing a rabble on said slag-free zone of the bath surface, and moving said rabble substantially along the plane of said slag-free bath surface zone in the direction toward the lowered side of said vessel thereby pushing the collectively melted synthetically entrapped proceeding slag with the aid of said rabble for removal thereof toward and over the lowered rim arc of said vessel.

2. A method in combination according to claim 1, which includes the step of introducing said rinsing gas below the bath surface within the region of the lifted vessel side to thereby cause the rising rinsing gas to create said slag-free zone.

3. A method in combination according to claim 2, which includes the step of introducing rinsing gas by conduit means into the vessel wall to pass rinsing gas through said conduit means into said metal bath.

4. A method in combination according to claim 3, in which introducing said rinsing gas by conduit means occurs through the rear wall of said vessel.

5. A method in combination according to claim 2, in which introducing said rinsing gas into said vessel occurs through the bottom of the latter.

6. A method in combination according to claim 1, in which said slag powder is applied to the metal bath within the region between the slag and the rabble.

7. A method in combination according to claim 6, in which the application of the slag powder is continued during the withdrawal of the slag by means of the rabble.

8. A method in combination according to claim 7, in which the slag powder being applied consists of 70 – 85% $SiO_2$, 10 – 18% $Al_2O_3$, 3 – 8% $K_2O$ and 2 – 6% $Na_2O$.

9. A method in combination according to claim 7, in which the slag powder being applied consists of 73 – 78% $SiO_2$, 10 – 14% $Al_2O_3$, 3 – 6% $K_2O$ and 2 – 5% $Na_2O$.

10. A method in combination according to claim 7, in which the rinsing gas is continued to cause the creation of a slag-free zone while the slagging by means of the rabble is being carried out.

11. A method according to claim 1, which includes the step of introducing said rinsing gas into said metal bath through at least one immersing lance.

12. A method according to claim 11, in which said immersing lance is immersed into the bath within the region of the lifted vessel side.

* * * * *